US006041925A

United States Patent [19]

Grendol

[11] Patent Number: 6,041,925

[45] Date of Patent: Mar. 28, 2000

[54] SELF-LOCKABLE LOOP FASTENER AND RUNNER BARS THEREWITH

[75] Inventor: Clark L. Grendol, Sturbridge, Mass.

[73] Assignee: Avery Dennison Corporation, Pasadena, Calif.

[21] Appl. No.: 08/938,120

[22] Filed: Sep. 26, 1997

[51] Int. Cl.[7] ..... B65D 5/24; B65D 55/06

[52] U.S. Cl. ..... 206/343; 24/16 PB; 24/30.5 P; 292/321; 292/322

[58] Field of Search ..... 24/16 PB, 17 AP, 24/704.2, 30.5 P; 292/318, 319, 321, 322; 206/343, 345, 346; D8/382

[56] References Cited

U.S. PATENT DOCUMENTS

| | | | |
|---|---|---|---|
| 2,935,773 | 5/1960 | Weckesser | 24/16 PB |
| 3,367,701 | 2/1968 | Wenk, Jr. | 292/321 |
| 3,712,655 | 1/1973 | Fuehrer | 292/321 |
| 3,733,657 | 5/1973 | Lankton | 206/343 |
| 3,744,105 | 7/1973 | Lanta | 292/322 X |
| 3,753,586 | 8/1973 | Patterson | 292/322 |
| 3,931,667 | 1/1976 | Merser et al. | 292/322 X |
| 3,979,799 | 9/1976 | Merser et al. | 206/346 |
| 4,183,567 | 1/1980 | Bone | 292/318 |
| 4,198,772 | 4/1980 | Furutu | 292/318 X |
| 4,240,183 | 12/1980 | Sumimoto et al. | 24/16 PB |
| 4,283,816 | 8/1981 | Tanaka | 24/16 PB X |
| 4,441,233 | 4/1984 | Swift | 24/16 PB |
| 4,534,464 | 8/1985 | Lankton | 206/343 |
| 4,559,676 | 12/1985 | Paradis . | |
| 4,640,320 | 2/1987 | Avison et al. | 24/16 PB X |
| 4,680,836 | 7/1987 | Wisecup | 24/704.2 |
| 4,958,414 | 9/1990 | Benoit | 24/16 PB |
| 5,042,535 | 8/1991 | Schlottke | 24/16 PB X |
| 5,116,091 | 5/1992 | Swift | 292/318 |
| 5,687,455 | 11/1997 | Alexander | 24/16 PB |
| 5,799,375 | 9/1998 | Fukami . | |

FOREIGN PATENT DOCUMENTS

| | | | |
|---|---|---|---|
| 1418989 | 3/1966 | France | 24/30.5 P |
| 2714918 | 10/1978 | Germany | 292/322 |

*Primary Examiner*—Bryon P. Gehman
*Attorney, Agent, or Firm*—Kriegsman & Kriegsman

[57] ABSTRACT

A self-lockable loop fastener adapted for attaching tags and the like to articles of commerce. According to one embodiment, the fastener includes an elongated flexible filament, a receiving part disposed at one end of the flexible filament and an inserting part disposed at the opposite end of the flexible filament. The receiving part has a longitudinal axis extending generally perpendicular to that of the filament and includes a socket. The socket is provided with an aperture, the aperture having a longitudinal axis extending generally parallel to that of the filament. A circumferential flange is disposed within the aperture to reduce the diameter of a portion of aperture. The inserting part, which has a longitudinal axis extending generally perpendicular to that of the filament but generally parallel to that of the receiving part, includes a plug, the plug being insertable into the aperture and past the flange. The plug includes a pair of spring tabs which, once inserted past the flange, prevent the plug from being withdrawn back past the flange. The inserting part also includes a stop, the stop being spaced from the plug to prevent the plug from being pushed forward through the aperture to a point where the tabs can be easily manipulated in such a way as to enable the withdrawal of the plug back past the flange. The invention is also directed to a fastener clip including the above fastener, a first runner bar severably connected to the fastener inserting part and a second runner bar severably connected to the fastener receiving part, the two runner bars being parallel to one another, perpendicular to the fastener filament and coplanar with the fastener filament.

20 Claims, 4 Drawing Sheets

SELF-LOCKABLE LOOP FASTENER AND RUNNER BARS THEREWITH

BACKGROUND OF THE INVENTION

The present invention relates generally to fasteners of the type that are commonly used to attach tags to articles of commerce and more particularly to self-lockable loop fasteners of the aforementioned type.

Fasteners of the type commonly used to attach tags to articles of commerce are well-known and widely used. Typically, such fasteners are unitary structures made of molded plastic. One of the earlier types of such fasteners, which is still in widespread use today, includes an elongated, flexible filament having a cross-bar disposed at a first end thereof and either a paddle or a second cross-bar disposed at the second end thereof. In use, the cross-bar disposed at the first end is typically inserted first through a tag and then through the desired article of commerce, with the paddle or second cross-bar not being inserted through the article in order to retain the fastener and the tag on the article. Typically, a plurality of the aforementioned fasteners are fabricated together, either as part of a fastener clip or as continuously connected fastener stock. The clip-type arrangement is disclosed, for example, in U.S. Pat. No. 3,103,666, inventor Bone, which issued Sep. 17, 1963, and which is incorporated herein by reference. An example of continuously-connected fastener stock is disclosed in U.S. Pat. No. 4,121,487, inventor Bone, which issued Oct. 24, 1978, and which is incorporated herein by reference.

As can be seen in the aforementioned '666 patent, in a clip-type arrangement, the cross-bars at the first ends of the respective fasteners are arranged parallel to one another, with each such cross-bar being connected to a common, perpendicularly-extending, runner bar by a severable connector. In addition, the paddles or cross-bars located at the second ends of the respective fasteners are also arranged parallel to one another. Such paddles or cross-bars at the second ends may or may not be connected to one another by severable connectors.

Although, in theory, an individual fastener from the above-described clip could be attached to a desired article by manually detaching the cross-bar at the first end of the fastener from the runner bar and then manually inserting said cross-bar through the desired article, it should be appreciated that the manual insertion of said cross-bar through most articles is very difficult to achieve in practice. This is in part because, to insert the cross-bar through an article (or through a hole in a tag), one must first pivot the cross-bar about the first end of the filament so that the cross-bar is placed in a generally parallel orientation relative to the filament and then, while maintaining said generally parallel orientation, one must insert the cross-bar through the article. However, due to the relatively small size of the cross-bar and the somewhat limited flexibility of the filament at its juncture with the cross-bar, said pivoting action is difficult to perform manually. The manual insertion of a cross-bar through an article is also made difficult by the fact that the cross-bar does not easily penetrate certain types of materials of which the article may be made. Accordingly, for the foregoing and other reasons, fasteners of the type described above, as well as fasteners constituting continuously connected fastener stock, have typically been dispensed using appropriate fastener dispensing tools.

Examples of fastener dispensing tools adapted for dispensing fasteners from fastener clips of the type described above are disclosed in the following U.S. patents, all of which are incorporated herein by reference: U.S. Pat. No. 3,103,666, inventor Bone, which issued Sep. 17, 1963; U.S. Pat. No. 4,611,740, inventor Kunreuther, which issued Sep. 16, 1986; U.S. Pat. No. 4,040,555, inventor Jenkins, which issued Aug. 9, 1977; U.S. Pat. No. 4,706,362, inventor Strausburg, which issued Nov. 17, 1987; U.S. Pat. No. 4,125,215, inventor Jenkins, which issued Nov. 14, 1978; U.S. Pat. No. 5,020,713, inventor Kunreuther, which issued Jun. 4, 1991; and U.S. Pat. No. 5,529,233, inventors Davignon et al., which issued Jun. 25, 1996.

Examples of fastener dispensing tools adapted for dispensing fasteners from continuously connected fastener stock are disclosed in the following U.S. patents, all of which are incorporated herein by reference: U.S. Pat. No. 4,121,487, inventor Bone, which issued Oct. 24, 1978; U.S. Pat. No. 5,320,269, inventors Deschenes et al., which issued Jun. 14, 1994; U.S. Pat. No. 4,955,475, inventors McCarthy et al., which issued Sep. 11, 1990; U.S. Pat. No. 4,456,161, inventor Russell, which issued Jun. 26, 1984; U.S. Pat. No. 5,024,365, inventor Bourque, which issued Jun. 18, 1991; and U.S. Pat. No. 4,998,661, inventors Deschenes et al., which issued Mar. 12, 1991.

Whereas filamentary fasteners of the type described above having a cross-bar at a first end thereof and a paddle or a cross-bar at a second thereof are quite useful in attaching tags to many articles of commerce, such fasteners have limited tag-attaching utility for certain articles of commerce, such as sunglasses, which are not made of a material through which the cross-bar may be inserted and then retained thereagainst. For the foregoing reasons, as well as for other applications, various loop fasteners have been devised. One class of loop fasteners is commonly referred to in the art as self-lockable loop fasteners.

Self-lockable loop fasteners typically comprise a flexible filament having a longitudinally-extending plug at a first end thereof and a transversely-oriented socket at a second end thereof. (Some self-lockable loop fasteners include a cross-bar at one end of the flexible filament, instead of the aforementioned plug, said cross-bar extending parallel to the socket.) Typically, the socket is tubular in shape with opposing open ends and is provided with an apertured wall (or one or more flanges defining an opening of reduced size compared to the remainder of the socket) that divides the tube transversely into a pair of symmetric portions. Typically, the plug is conical in shape and/or includes spring tabs to enable the plug to be inserted through the apertured wall from either end of the socket while, at the same time, preventing the plug from being withdrawn through the apertured wall after having been inserted therethrough. The spring tabs are typically arranged in a plane perpendicular to the longitudinal axis of the socket. Self-lockable loop fasteners typically further include a stop, the stop being sized so as not to be insertable through the apertured wall and being positioned at a distance between the plug and the socket so as to prevent the plug from being pulled through the opposite open end of the socket to a point where it is accessible for tampering. Accordingly, once the plug has been inserted through the apertured wall or flange, the fastener locks itself into a loop of a substantially fixed size.

Self-lockable loop fasteners are to be contrasted with other types of loop fasteners, such as cinching loop fasteners or cable ties (see U.S. Pat. No. 5,333,822, inventors Benoit et al., which issued Aug. 2, 1994 and which is incorporated herein by reference) and shoe-lasting loop fasteners (see U.S. Pat. No. 5,438,724, inventor Merser, which issued Aug. 8, 1995; U.S. Pat. No. 5,586,353, inventor Merser, which issued Dec. 24, 1996; and PCT Appln. No. PCT/US96/

19479, filed Jun. 12, 1997, all of which are incorporated herein by reference).

Examples of self-lockable loop fasteners include the Secur-a-tach® family of fasteners commercially available from Avery Dennison Corporation, Framingham, Mass. Self-lockable loop fasteners are also described in the following U.S. patents and patent applications, all of which are incorporated herein by reference: U.S. Pat. No. 3,979,799, inventors Merser et al., which issued Sep. 14, 1976; U.S. Pat. No. 4,559,676, inventor Paradis, which issued Dec. 24, 1985; U.S. Pat. No. 4,183,567, inventor Bone, which issued Jan. 15, 1980; U.S. Design Pat. No. 266,484, inventor Bone, which issued Oct. 12, 1982; U.S. Design Pat. No. 262,436, inventor Bone, which issued Dec. 29, 1981; U.S. Pat. No. 4,245,374, inventor Suzuki, which issued Jan. 20, 1981; U.S. Pat. No. 4,240,183, inventors Sumimoto et al., which issued Dec. 23, 1980; and commonly-assigned, presently pending U.S. patent application Ser. No. 08/829,992, inventors Merser et al., filed Apr. 2, 1997.

Self-lockable loop fasteners are typically mass-produced in clips or assemblies of molded plastic, with each fastener of the clip typically being attached by a severable connector to a common runner bar. Traditionally, to remove an individual self-lockable loop fastener from its fastener clip, the fastener is manually pulled away from the runner bar until the severable connector connecting the fastener to the runner bar breaks. In use, the plug end of the fastener is typically manually inserted into its corresponding socket in the manner specified above. Although the manual insertion of a plug into its corresponding socket is less difficult than the above-described manual insertion of a cross-bar into and through an article of commerce, it can readily be appreciated that such an activity, repeatedly performed for successive fasteners over extended periods of time, can be time-consuming, as well as physically and mentally taxing.

Accordingly, efforts have recently been expended in the development of tools that can be used both in detaching individual self-lockable loop fasteners from fastener clips or assemblies containing same and in inserting the plug end of a fastener into the socket end thereof. Examples of such tools are disclosed in the following U.S. patents, all of which are incorporated herein by reference: U.S. Pat. No. 5,501,002, inventor Fukami, which issued Mar. 26, 1996; U.S. Pat. No. 4,483,066, inventor Akira, which issued Nov. 20, 1984; and U.S. Pat. No. 4,536,933, inventor Furutsu, which issued Aug. 27, 1985.

Notwithstanding the existence of the aforementioned patents, a tool for dispensing self-lockable loop fasteners of the type having a plug at one end and a socket at the opposite end has not yet achieved widespread commercial success.

SUMMARY OF THE INVENTION

It is an object of the present invention to provide a novel loop fastener.

It is another object of the present invention to provide a novel loop fastener that can be mass-produced in multi-fastener clips made of molded plastic.

According to one aspect of the present invention, there is provided a loop fastener, said loop fastener comprising (a) a flexible filament, said flexible filament having a longitudinal axis, a first end and a second end; (b) a receiving part disposed at said first end of said flexible filament, said receiving part having an aperture and a flange, said flange extending partially into said aperture, said aperture having a longitudinal axis parallel to the longitudinal axis of said flexible filament; and (c) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange.

According to another aspect of the present invention, there is provided a loop fastener, said loop fastener comprising (a) a flexible filament, said flexible filament having a longitudinal axis, a first end and a second end; (b) a receiving part disposed at said first end of said flexible filament, said receiving part having an aperture and a flange, said flange extending partially into said aperture; and (c) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange, said inserting part having a longitudinal axis perpendicular to the longitudinal axis of said flexible filament.

According to yet another aspect of the present invention, there is provided a fastener clip, said fastener clip comprising (a) a loop fastener, said loop fastener comprising (i) a flexible filament, said flexible filament having a first end and a second end, (ii) a receiving part disposed at said first end of said flexible filament, said receiving part having an aperture and a flange, said flange extending partially into said aperture, and (iii) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange; (b) a first runner bar, said first runner bar being severably connected to said receiving part and being coplanar with said flexible filament; and (c) a second runner bar, said second runner bar being severably connected to said inserting part and being coplanar with said flexible filament.

According to still another aspect of the present invention, there is provided a method of forming a looped fastener, said method comprising the steps of (a) providing a fastener clip, said fastener clip comprising (i) a loop fastener, said loop fastener comprising (A) a flexible filament, said flexible filament having a first end and a second end, (B) a receiving part disposed at said first end of said flexible filament, said receiving part having an aperture and a flange, said flange extending partially into said aperture, and (C) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange; (ii) a first runner bar, said first runner bar being severably connected to said receiving part and being coplanar with said flexible filament; and (iii) a second runner bar, said second runner bar being severably connected to said inserting part and being coplanar with said flexible filament; (b) separating said inserting part from said second runner bar; (c) separating said receiving part from said first runner bar; and (d) inserting said plug into said aperture and past said flange.

Additional objects, as well as features and advantages, of the present invention will be set forth in part in the detail description which follows, and in part will be obvious from the detailed description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated in and constitute a part of this specification, illustrate the preferred embodiments of the invention and, together with the description, serve to explain the principles of the invention. In the drawings, wherein like reference numerals represent like parts.

DETAILED DESCRIPTION OF PREFERRED EMBODIMENTS

Figure 1:
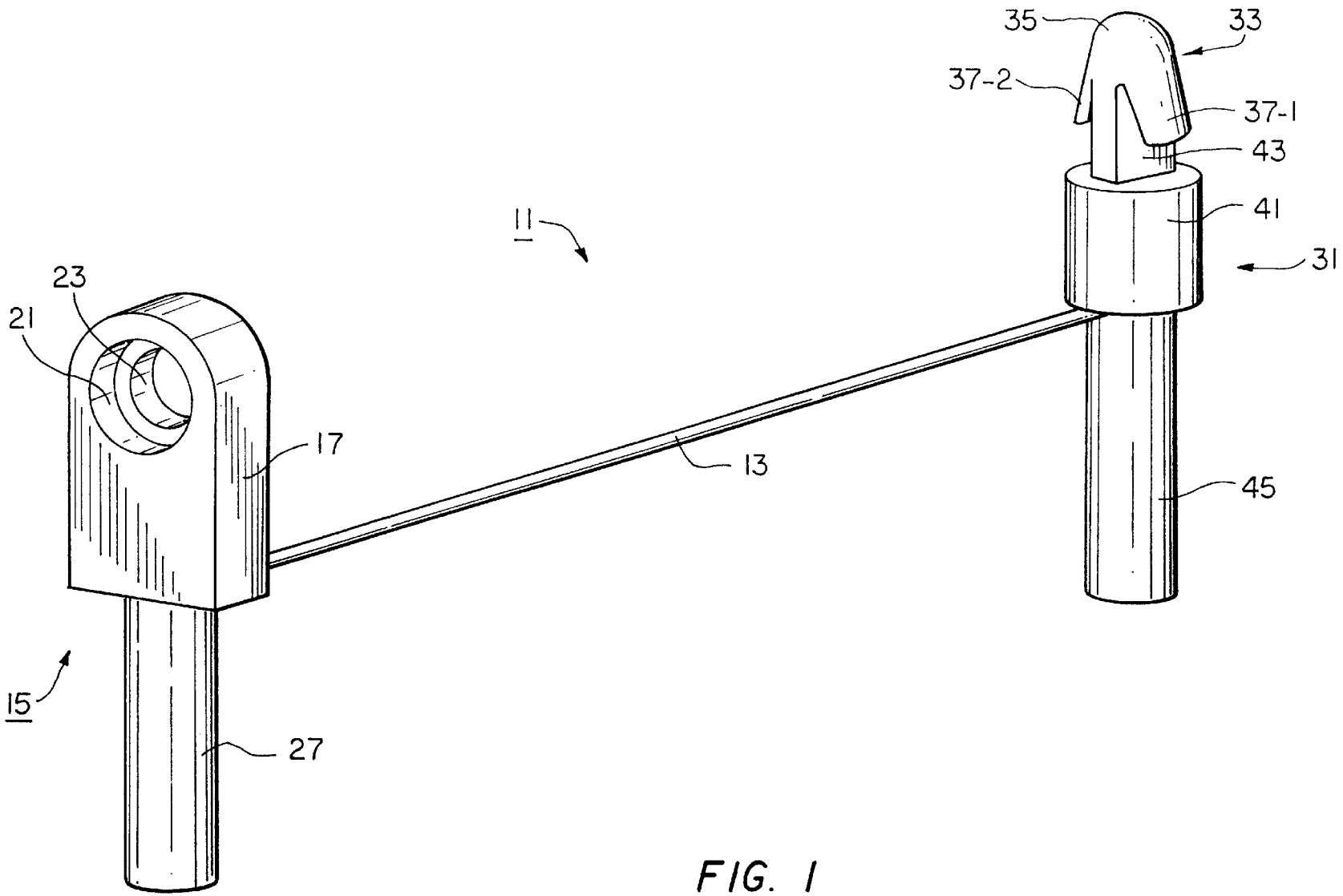
FIG. 1 is a front perspective view of one embodiment of a self-lockable loop fastener constructed according to the teachings of the present invention.

Referring now to FIG. 1, there is shown a perspective view of one embodiment of a self-lockable loop fastener constructed according to the teachings of the present invention, the self-lockable loop fastener being represented generally by reference numeral 11.

Fastener 11 comprises an elongated flexible filament 13. Although filament 13 is shown in FIG. 1 having a generally circular cross-sectional shape, various other cross-sectional shapes may also be suitable.

Fastener 11 also comprises a receiving part 15, receiving part 15 being disposed at one end of flexible filament 13. Receiving part 15, which has a longitudinal axis extending generally perpendicular to that of filament 13, includes a socket 17. Socket 17 is provided with a transverse aperture 21, aperture 21 having a longitudinal axis extending generally parallel to that of filament 13. A circumferential flange 23 is disposed within aperture 21, flange 23 serving to reduce the diameter of a portion of aperture 21 for reasons to become apparent below.

Receiving part 15 also includes a post 27, post 27 extending downwardly from the bottom of socket 17. Post 27 may be used to hold and/or to position receiving part 15.

Fastener 11 further comprises an inserting part 31, inserting part 31 being disposed at the opposite end of flexible filament 13. Inserting part 31, which has a longitudinal axis extending generally perpendicular to that of filament 13 but generally parallel to that of receiving part 15, includes a plug 33. Plug 33 is shaped to include a cone-shaped head 35 and a pair of spring tabs 37-1 and 37-2, the free ends of spring tabs 37-1 and 37-2 being outwardly biasing. Plug 33 is appropriately dimensioned so that, during forward insertion of plug 33 past flange 23, tabs 37-1 and 37-2 are compressed inwardly, and head 35 and tabs 37-1 and 37-2 are insertable into aperture 21 and past flange 23 of socket 17. Plug 33 is also dimensioned, however, so that, when no compressing force is applied to tabs 37-1 and 37-2 (i.e., after tabs 37-1 and 37-2 have been inserted fully past flange 23), tabs 37-1 and 37-2 expand outwardly and plug 33 cannot be withdrawn back past flange 23. As can readily be appreciated, plug 33 could alternatively be shaped so as not to include spring tabs 37-1 and 37-2, but rather, to include merely a cone-shaped head, with the lower extremity of such a cone-shaped head serving to engage flange 23 and thereby to prevent withdrawal of the plug back past flange 23.

Inserting part 31 also includes a stop 41, stop 41 being appropriately dimensioned so as to be insertable into aperture 21 but not insertable past flange 23. Stop 41 is connected to plug 33 by a neck 43, neck 43 having a sufficiently short length so that plug 33 cannot continue to be pulled through aperture 21 past flange 23 to a point where tabs 37-1 and 37-2 can be easily manipulated (i.e., compressed) in such a way as to enable the withdrawal of plug 33 back past flange 23.

Inserting part 31 further includes a post 45, post 45 extending downwardly from the bottom of stop 41. Post 45 may be used to hold and/or to position inserting part 31.

Figure 2:
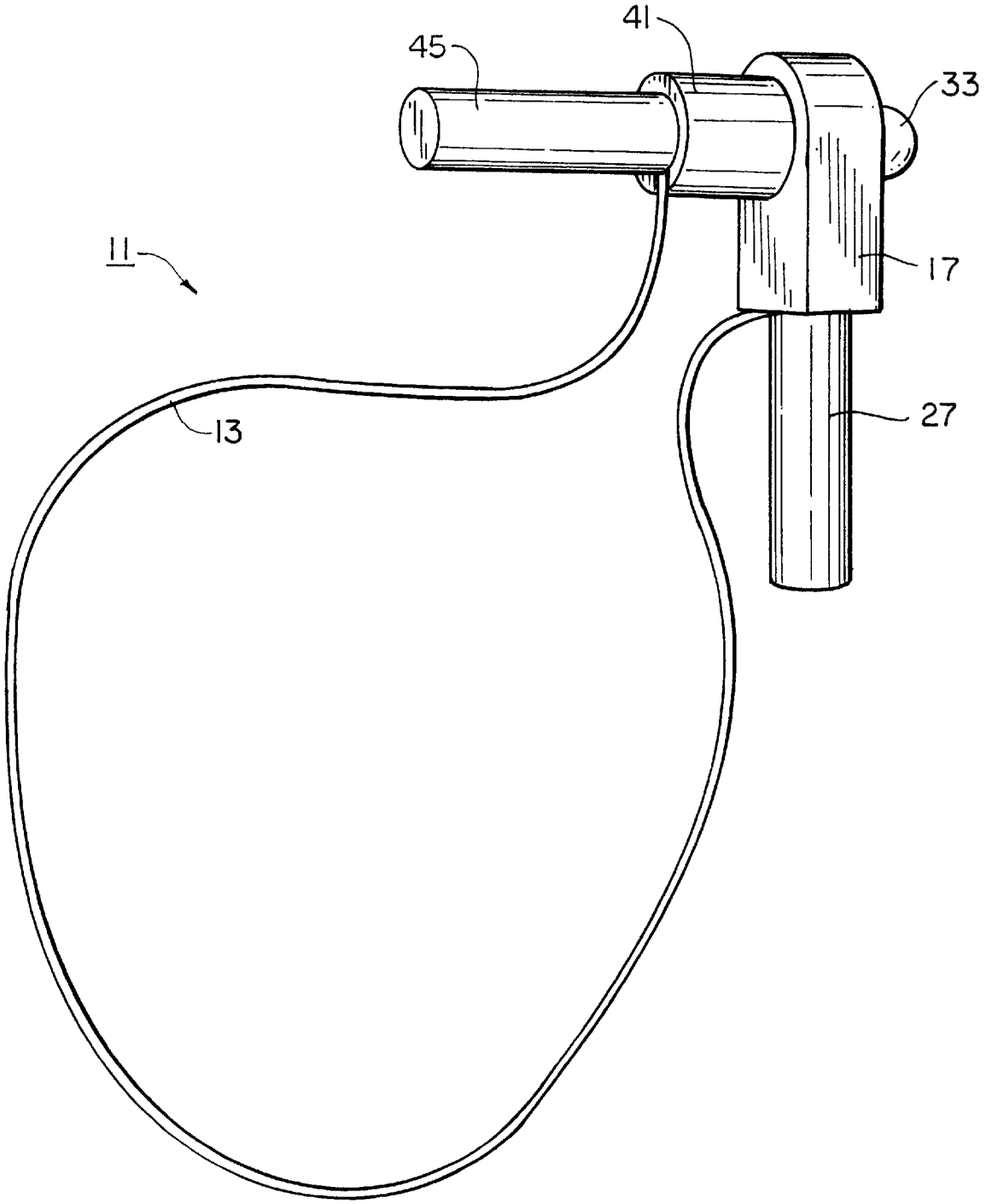
FIG. 2 is a rear perspective view of the self-lockable loop fastener of FIG. 1 shown in use in a locked loop state.

To form a self-locked loop (see FIG. 2) using fastener 11, one inserts plug 33 of inserting part 31 into aperture 21 and fully past flange 23 of socket 17. Stop 41 prevents further insertion of plug 33 through aperture 21 and prevents the necessary access to tabs 37-1 and 37-2 for plug 33 to be withdrawn back past flange 23. Accordingly, fastener 11 forms a loop of a fixed size.

One advantage of fastener 11, as compared to conventional self-locking loop fasteners of the type having a socket at one end of a flexible filament and a plug at the opposite end thereof, is that, for plug 33 to be aligned with aperture 21, flexible filament 13 need only be bent so that inserting part 31 (or receiving part 15) is re-positioned 90 degrees relative to its initial orientation. This is in sharp contrast with conventional self-locking loop fasteners wherein the flexible filament must be bent so that the plug (or socket) is re-positioned 270 degrees relative to its initial orientation.

Fastener 11 is preferably a unitary structure made of molded plastic. If desired, filament 13 may be molded to a certain initial length and initial cross-sectional thickness and then stretched in the conventional manner to a desired final length and final cross-sectional thickness.

Figure 3:
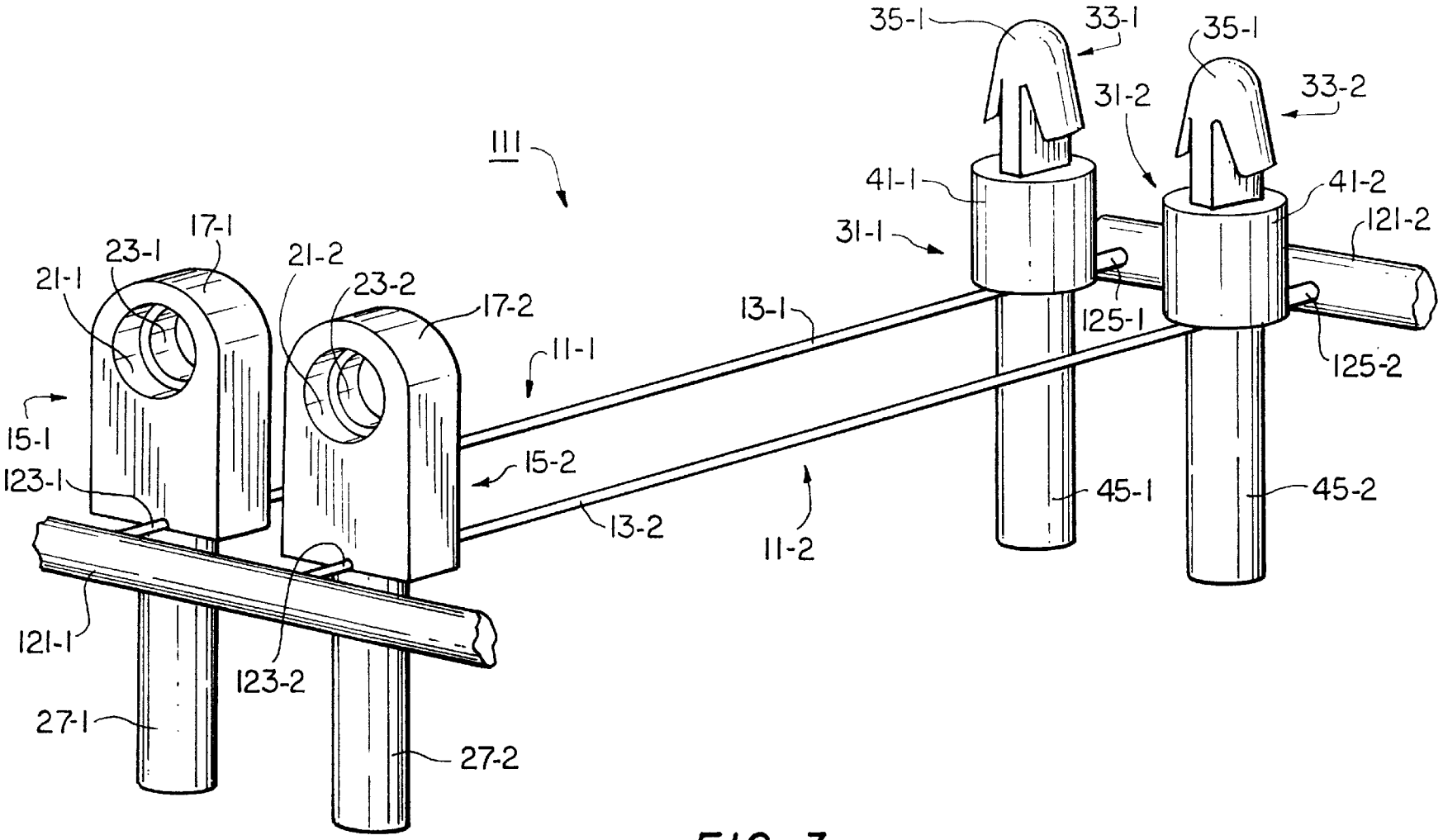
FIG. 3 is a fragmentary front perspective view of one embodiment of a fastener clip constructed according to the teachings of the present invention, the fastener clip including a plurality of the self-lockable loop fasteners of FIG. 1.
Figure 4:
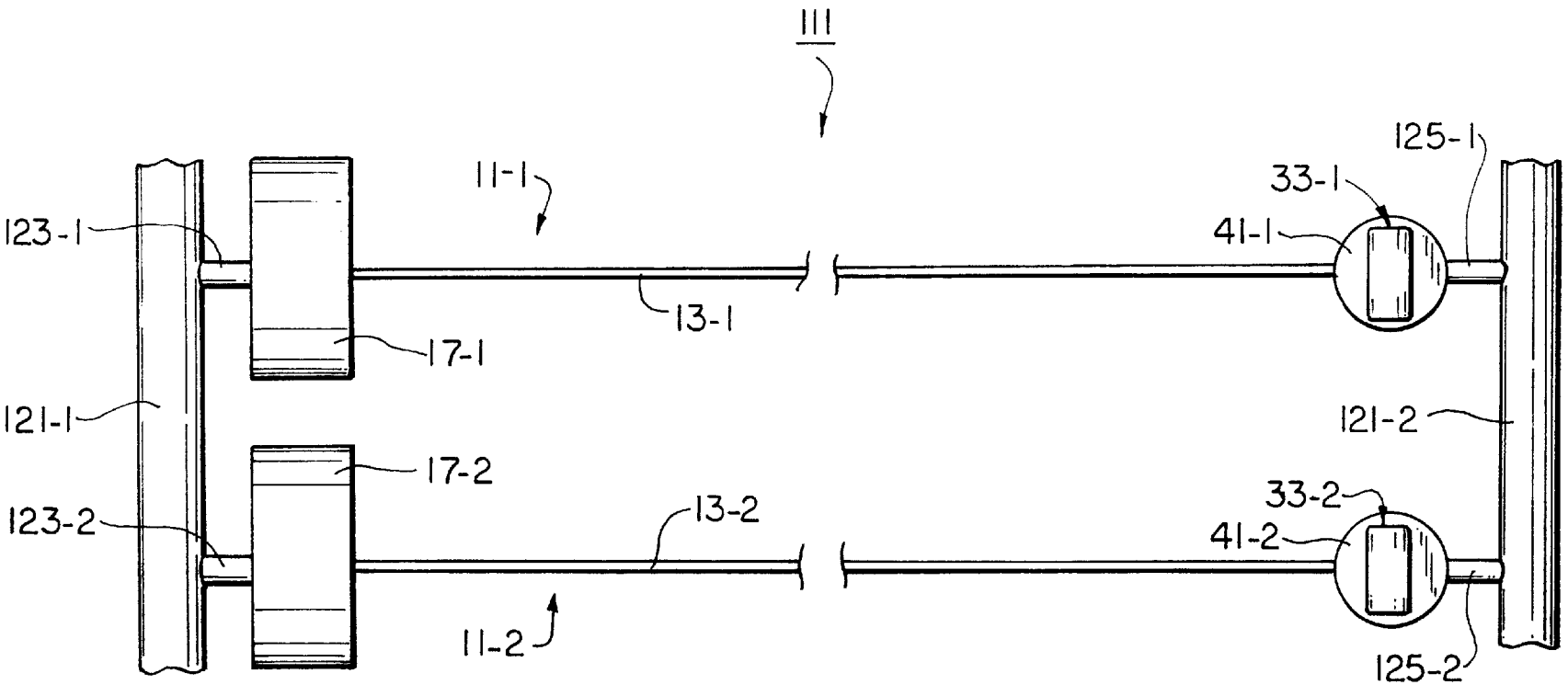
FIG. 4 is a fragmentary top view of the fastener clip shown in FIG. 3.

Referring now to FIGS. 3 and 4, there are shown perspective and top views of one embodiment of a fastener clip constructed according to the teachings of the present invention, the fastener clip being represented generally by reference numeral 111.

Fastener clip 111 includes a plurality of identical fasteners 11-1 and 11-2, fasteners 11-1 and 11-2 being parallel to and aligned with one another. Although two fasteners 11 are shown in the present embodiment, it should be understood that fastener clip 111 may include any number of fasteners 11 and that the number of fasteners 11 shown herein is merely illustrative.

Fastener clip 111 also includes a pair of runner bars 121-1 and 121-2. Runner bars 121-1 and 121-2, which are parallel to one another and perpendicular to filaments 13-1 and 13-2, are co-planar with filaments 13-1 and 13-2. Runner bar 121-1 is connected to receiving parts 15-1 and 15-2 of fasteners 11-1 and 11-2 by severable connectors 123-1 and 123-2, respectively. Runner bar 121-2 is connected to inserting parts 31-1 and 31-2 of fasteners 11-1 and 11-2 by severable connectors 125-1 and 125-2, respectively.

Fastener clip 111 is preferably a unitary structure made of molded plastic. If desired, filaments 13-1 and 13-2 may be molded to a certain initial length and initial cross-sectional thickness and then stretched to a desired final length and final cross-sectional thickness using a conventional stretching process, such as that disclosed in U.S. Pat. No. 4,559,676, which is incorporated herein by reference.

To remove an individual fastener 11 from clip 111, one severs those connectors 123 and 125 that connect the fastener 11 to the remainder of clip 111. This may be done, for example, by manually pulling runner bars 121-1 and 121-2 away from the receiving part 15 and the inserting part 31, respectively, of the fastener 11 until the connectors 123 and 125 break. Once the individual fastener 11 has been separated from the remainder of the clip 111, it may be used in the manner described above to form a self-locking loop.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A loop fastener comprising:

(a) a flexible filament, said flexible filament having a longitudinal axis, a first end and a second end;

(b) a receiving part disposed at said first end of said flexible filament, said receiving part comprising a socket, said socket having a transverse aperture and a flange, said flange extending partially into said transverse aperture, said transverse aperture having a longitudinal axis parallel to the longitudinal axis of said flexible filament; and (c) an inserting part disposed at said second end of said flexible filament, said inserting part including a plug insertable into said transverse aperture and past said flange, said plug having means for engaging said flange after said plug has been inserted past said flange to prevent said plug from being withdrawn from said transverse aperture back past said flange.

2. The loop fastener as claimed in claim 1 wherein said flexible filament, said receiving part and said inserting part form a unitary structure.

3. The loop fastener as claimed in claim 1 wherein said flange is a circumferential flange disposed within said transverse aperture.

4. The loop fastener as claimed in claim 1 wherein said receiving part further comprises a post, said post extending away from the bottom of said socket.

5. The loop fastener as claimed in claim 1 wherein said plug comprises a head and wherein said engaging means comprises a pair of outwardly biasing spring tabs attached at one end to said head.

6. The loop fastener as claimed in claim 1 wherein said inserting part further comprises a stop for delimiting forward insertion of said plug through said transverse aperture.

7. The loop fastener as claimed in claim 6 wherein said stop is positioned relative to said plug to prevent tampering with said engaging means once said engaging means has been inserted past said flange.

8. The loop fastener as claimed in claim 6 wherein said inserting means further comprises a post, said post extending away from the bottom of said stop.

9. A loop fastener comprising:

(a) a flexible filament, said flexible filament having a longitudinal axis, a first end and a second end;

(b) a receiving part disposed at said first end of said flexible filament, said receiving part having an aperture and a flange, said aperture having a longitudinal axis parallel to the longitudinal axis of said flexible filament, said flange extending partially into said aperture; and (c) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange, said inserting part having a longitudinal axis perpendicular to the longitudinal axis of said flexible filament.

10. A fastener clip comprising:

(a) a loop fastener, said loop fastener comprising (i) a flexible filament, said flexible filament having a first end and a second end, (ii) a receiving part disposed at said first end of said flexible filament, said receiving part having an aperture and a flange, said aperture having a longitudinal axis parallel to the longitudinal axis of said flexible filament, said flange extending partially into said aperture, and (iii) an inserting part disposed at said second end of said flexible filament, said inserting part having a longitudinal axis perpendicular to the longitudinal axis of said flexible filament, said inserting part including a plug insertable into said aperture and past said flange, said plug having means for engaging said flange after said plug has been inserted past said flange to prevent said plug from being withdrawn from said aperture back past said flange;

(b) a first runner bar, said first runner bar being severably connected to said receiving part and being coplanar with said flexible filament; and (c) a second runner bar, said second runner bar being severably connected to said inserting part and being coplanar with said flexible filament.

11. A method of forming a looped fastener, said method comprising the steps of:

(a) providing a fastener clip, said fastener clip comprising (i) a loop fastener, said loop fastener comprising (A) a flexible filament, said flexible filament having a first end and a second end, (B) a receiving part disposed at said first end of said flexible filament, said receiving part comprising a socket, said socket having a transverse aperture and a flange, said flange extending partially into said transverse aperture, said transverse aperture having a longitudinal axis parallel to the longitudinal axis of said flexible filament, and (C) an inserting part disposed at said second end of said flexible filament, said inserting part including a plug insertable into said transverse aperture and past said flange, said plug having means for engaging said flange after said plug has been inserted past said flange to prevent said plug from being withdrawn from said transverse aperture back past said flange;

(ii) a first runner bar, said first runner bar being severably connected to said receiving part and being coplanar with said flexible filament; and (iii) a second runner bar, said second runner bar being severably connected to said inserting part and being coplanar with said flexible filament;

(b) separating said inserting part from said second runner bar;

(c) separating said receiving part from said first runner bar; and (d) inserting said plug into said transverse aperture and past said flange.

12. A method of forming a looped fastener, said method comprising the steps of:

(a) providing a fastener clip, said fastener clip comprising (i) a loop fastener, said loop fastener comprising (A) a flexible filament, said flexible filament having a first end and a second end, (B) a receiving part disposed at said first end of said flexible filament, said receiving part having an aperture and a flange, said aperture having a longitudinal axis parallel to the longitudinal axis of said flexible filament, said flange extending partially into said aperture, and (C) an inserting part disposed at said second end of said flexible filament, said inserting part having a longitudinal axis perpendicular to the longitudinal axis of said flexible filament, said inserting part including a plug insertable into said aperture and past said flange, said plug having means for engaging said flange after said plug has been inserted past said flange to prevent said plug from being withdrawn from said aperture back past said flange;

(ii) a first runner bar, said first runner bar being severably connected to said receiving part and being coplanar with said flexible filament; and (iii) a second runner bar, said second runner bar being severably connected to said inserting part and being coplanar with said flexible filament;

(b) separating said inserting part from said second runner bar;

(c) separating said receiving part from said first runner bar; and (d) inserting said plug into said aperture and past said flange.

13. The method as claimed in claim 12 wherein said inserting part further comprises a stop for delimiting forward insertion of said plug through said aperture.

14. The method as claimed in claim 13 wherein said stop is positioned relative to said plug to prevent tampering with said engaging means once said engaging means has been inserted past said flange.

15. A loop fastener comprising:

(a) a flexible filament, said flexible filament having a longitudinal axis, a first end and a second end;

(b) a receiving part disposed at said first end of said flexible filament, said receiving part comprising a socket, said socket having an aperture and a flange, said flange extending partially into said aperture, said aperture having a longitudinal axis parallel to the longitudinal axis of said flexible filament; and (c) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange, said inserting part having a longitudinal axis perpendicular to the longitudinal axis of said flexible filament.

16. The loop fastener as claimed in claim 15 wherein said receiving part further comprises a receiving part post, said receiving part post extending away from the bottom of said socket and generally perpendicular to said flexible filament, and wherein said inserting part further comprises an inserting part post, said inserting part post extending generally perpendicular to said flexible filament.

17. A fastener clip comprising:

(a) a loop fastener, said loop fastener comprising (i) a flexible filament, said flexible filament having a first end and a second end, (ii) a receiving part disposed at said first end of said flexible filament, said receiving part including a socket, said socket having an aperture and a flange, said aperture having a longitudinal axis parallel to the longitudinal axis of said flexible filament, said flange extending partially into said aperture, and (iii) an inserting part disposed at said second end of said flexible filament, said inserting part including a plug insertable into said aperture and past said flange, said plug having means for engaging said flange after said plug has been inserted past said flange to prevent said plug from being withdrawn from said aperture back past said flange, said inserting part having a longitudinal axis perpendicular to the longitudinal axis of said flexible filament;

(b) a first runner bar, said first runner bar being severable connected to said receiving part and being coplanar with said flexible filament; and (c) a second runner bar, said second runner bar being severable connected to said inserting part and being coplanar with said flexible filament.

18. The fastener clip as claimed in claim 17 wherein said receiving part further comprises a receiving part post, said receiving part post extending generally perpendicular to said flexible filament, and wherein said inserting part further comprises an inserting part post, said inserting part post extending generally perpendicular to said flexible filament.

19. A method of forming a looped fastener, said method comprising the steps of:

(a) providing a fastener clip, said fastener clip comprising (i) a loop fastener, said loop fastener comprising (A) a flexible filament, said flexible filament having a first end and a second end, (B) a receiving part disposed at said first end of said flexible filament, said receiving part including a socket, said socket having an aperture and a flange, said aperture having a longitudinal axis parallel to the longitudinal axis of said flexible filament, said flange extending partially into said aperture, and (C) an inserting part disposed at said second end of said flexible filament, said inserting part including a plug insertable into said aperture and past said flange, said plus having means for engaging said flange after said plug has been inserted past said flange to prevent said plug from being withdrawn from said aperture back past said flange, said inserting part having a longitudinal axis perpendicular to the longitudinal axis of said flexible filament;

(ii) a first runner bar, said first runner bar being severable connected to said receiving part and being coplanar with said flexible filament; and (iii) a second runner bar, said second runner bar being severable connected to said inserting part and being coplanar with said flexible filament;

(b) separating said inserting part from said second runner bar;

(c) separating said receiving part from said first runner bar; and (d) inserting said plug into said aperture and past said flange.

20. The method as claimed in claim 19 wherein said receiving part further comprises a receiving part post, said receiving part post extending generally perpendicular to said flexible filament, and wherein said inserting part further comprises an inserting part post, said inserting part post extending generally perpendicular to said flexible filament.

* * * * *